United States Patent [19]

Laven

[11] Patent Number: 4,836,823

[45] Date of Patent: Jun. 6, 1989

[54] HEART SHAPED NOVELTY ITEM

[76] Inventor: Douglas J. Laven, 1223 N. Broad St., Mankato, Minn. 56001

[21] Appl. No.: 189,864

[22] Filed: May 3, 1988

[51] Int. Cl.[4] ..... A63H 33/26

[52] U.S. Cl. ..... 446/485; 362/806

[58] Field of Search ..... 446/485, 484; 362/104, 362/200, 800, 806, 807

[56] References Cited

U.S. PATENT DOCUMENTS

| | | | |
|---|---|---|---|
| 2,794,298 | 6/1957 | Mason | 446/485 X |
| 3,119,563 | 1/1964 | Ruffman | 446/485 X |
| 4,282,681 | 8/1981 | McCaslin | 446/484. |
| 4,508,520 | 4/1985 | Sellers et al. | 446/485 |
| 4,601,668 | 7/1986 | Sirota | 446/485 X |

*Primary Examiner*—Mickey Yu

*Attorney, Agent, or Firm*—Henderson & Sturm

[57] ABSTRACT

A novelty item having a heart shaped housing with a translucent window formed therein. The housing has two conductors formed on the exterior thereof. When the housing is held in a person's hand, a conductive path is formed between the two conductors, and one or more LEDs on the interior of the housing begin to flash on and off in symbolic representation of a beating heart. The flashing of the LEDs can be perceived through the translucent window. A stand can be provided to support the housing in a substantially upright position.

4 Claims, 1 Drawing Sheet

HEART SHAPED NOVELTY ITEM

TECHNICAL FIELD

This invention relates generally to novelty items, and particularly to novelty items that emit light.

BACKGROUND OF THE INVENTION

This invention was the subject matter of Document Disclosure Program Registration No. 180462 which was filed in the United States Patent and Trademark Office on Nov. 6, 1987.

Many novelty items are known in the prior art. Such items are often used as gift items and generally have the common purpose of amusing, entertaining, and/or pleasing the recipient in some way. Some novelty items are in the shape of, or otherwise include a representation of, a stylized heart. Novelty items that include such a representation are especially common during and around St. Valentine's Day. In general, such heart related novelty items constitute a symbol of affection.

In order to transmit the desired symbolic message, such a novelty item must include the traditional symbology; in the example considered above, the novelty item must include a heart shaped representation in order to symbolize the message of affection. At the same time, a need exists for new and fresh expressions of these same symbols. Such new expressions, of course, cannot stray too far from the traditional norms, or the context of the symbology will be lost or confused, and the novelty item will not serve its intended purpose.

BRIEF SUMMARY OF THE INVENTION

The above needs and others are substantially met through provision of the heart shaped novelty item disclosed herein.

This item includes generally a heart shaped housing of a size suitable to allow the housing to be held in a person's hand, two separated conductors mounted on the exterior of the housing, one or more light sources mounted interior of the housing, and a circuit that responds to the closing of a switch by causing the light sources to flash on and off.

In one embodiment, the switch includes the two separated conductors. A conductive path is formed between the two conductors when the housing is held in a person's hand. This conductive path closes the switch and thereby causes the light sources to flash on and off in symbolic representation of a heart beat.

In another embodiment of the invention, the housing includes a translucent window that visibly obscures the contents of the housing, but allows the light from the light sources to pass therethrough.

In another embodiment of the invention, the two conductors are mounted on a peripheral edge of the housing, and appear to the casual observer to be merely decorative in purpose.

In yet another embodiment of the invention, at least two light sources are provided, and the two light sources flash on and off at different rates.

In yet another embodiment of the invention the housing includes a stand formed therewith, such that the housing can be self supported in a substantially upright position.

BRIEF DESCRIPTION OF THE DRAWINGS

These and other attributes of the invention will become more clear upon making a thorough and complete review of the following description of the best mode for carrying out the invention, particularly when reviewed in conjunction with the drawings, wherein.

BEST MODE FOR CARRYING OUT THE INVENTION

Figure 1:
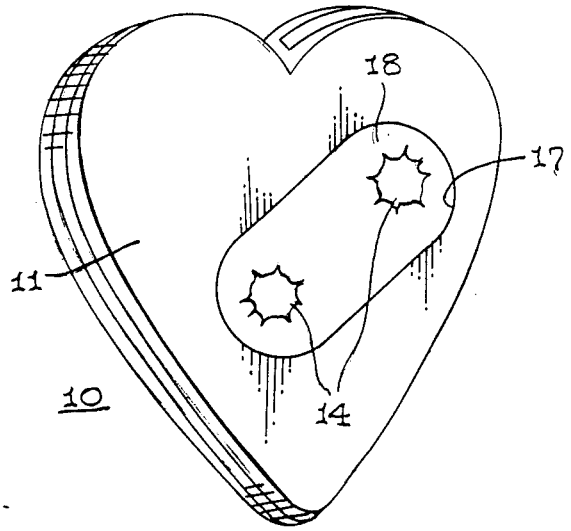
FIG. 1 comprises a front elevational view of the invention.

Referring now to the drawings, and in particular to FIG. 1, the novelty item can be seen as generally depicted by the numeral (10). The novelty item (10) includes generally a housing (11), two conductors (12 and 13), a light emitting source (14), and a light control circuit (16) (see FIG. 5). Each of the above generally referred to components will now be described in more detail in seriatim fashion.

Figure 2:
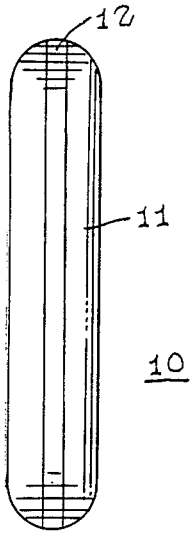
FIG. 2 comprises a side elevational view of the invention.
Figure 3:
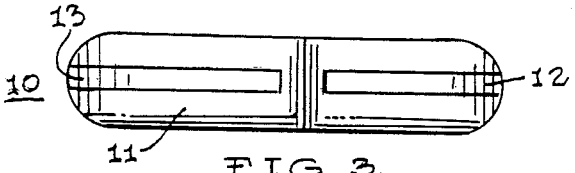
FIG. 3 comprises a top plan view of the invention.

With reference to FIGS. 1, 2, and 3, the housing (11) comprises a substantially heart shaped enclosure made of plastic or other suitable material. The front side of the housing (11) includes a hole (17) formed therethrough. This hole (17) has a sheet of translucent material (18) disposed therein. The translucent material (18) substantially occludes the interior of the housing (11), but does allow light to pass therethrough in a diffused manner.

If desired, lettering can be provided on either or both of the front and back sides of the housing (11). This lettering could, for example, provide messages appropriate to the context of the item and/or the occasion.

A first and second conductor (12 and 13) are disposed along a peripheral edge of the housing (11). the two conductors (12 and 13) do not contact one another. These conductors (12 and 13) are comprised of an appropriate conductive material, such as copper or silver. The conductors (12 and 13) may be located other than along the peripheral edge of the housing (11), but they should be located so that when the housing (11) is held in a person's hand, the person's hand will likely establish a conductive path between the two conductors (12 and 13). The purpose of this orientation will be explained in more detail below.

Figure 5:
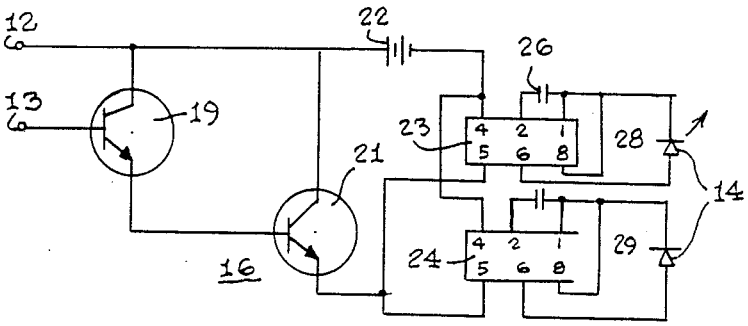
FIG. 5 comprises an electrical schematic of circuitry that comprises a part of the invention.

Referring now to FIG. 5, the first conductor (12) connects to the collector of a first transistor (19). The second conductor (13) connects to the base of the first transistor (19). The first and second transistors (19 and 21) are configured as a Darlington pair, and may be provided through use of NPN 2N3904 transistors. The collector output of the second transistor (21) connects through a 3 volt battery (22) to the ground ports (pin 4) of two LED flashers (23 and 24) as provided through use of two LM3909s.

The V+ port (pin 5) for both LED flashers (23 and 24) connects to the emitter output of the second transistor (21). The output port (pin 2) of each flasher (23 and 24) connects through a capacitor (26 and 27, respectively)to the Fast RC port (pin 1) thereof. The latter port (pin 1) also connects to the Slow RC port (pin 8) thereof and the cathode side of an LED (28 and 29, respectively) (the two LEDs comprise the light source (14) of the novelty item (10)). Lastly, the RL port (pin 6) of the flashers (23 and 24) connects to the anode side of the LEDs (28 and 29).

So configured, when the two conductors (12 and 13) are in electrical communication with one another, the LEDs (28 and 29) flashes on and off at a rate determined by the value of the capacitors (26 and 27) associated therewith. In this embodiment, the first capacitor (26) has a value of 220 microfarads and the second capacitor (27) has a value of 470 microfarads. With these values, the first LED (28) will flash on and off at a rate twice that at which the second LED (29) will flash on and off.

Figure 6:
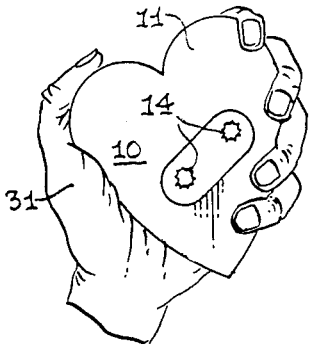
FIG. 6 comprises a depiction of the invention as held in the hand of a user.

Referring now to FIG. 6, the novelty item (10) can be held in the hand (31) of a person. When held in this way, a conductive path will be formed between the first and second conductors (12 and 13) that are mounted on the exterior of the housing (11). This conductive path will cause power to be provided to the LED flashers (23 and 24), and this will cause the LEDs to flash on and off in a manner symbolic of the beating of a heart. In this way, the added effects of the lighting not only complement the traditional symbolism of the heart, these same effects actually enhance and further suggest this same symbolic meaning.

Figure 4:
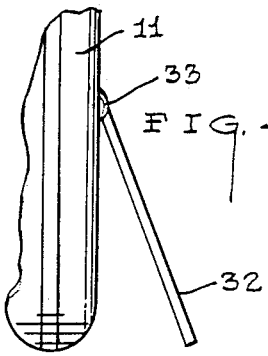
FIG. 4 comprises a cutaway detail view of another embodiment of the invention.

With reference to FIG. 4, a small stand (32) can be attached to the housing (11) to allow the novelty item (10) to be independently supported in a substantially upright position. For convenience, the stand (32) can be connected to the housing (11) through use of pivot construction (33) that allows the stand (32) to be disposed flat against the housing (11) when not in use.

I claim:

1. A novelty item comprising:

(A) a heart shaped housing of a size suitable to allow said heart shaped housing to be held in a person's hand;

(B) a first conductor mounted exterior to said heart shaped housing along a peripheral edge thereof;

(C) a second conductor mounted exterior to said heart shaped housing along said peripheral edge, wherein said first conductor and said second conductor do not contact one another;

(D) light emitting means for emitting light that is visible exterior of said heart shaped housing, wherein said light emitting means includes at least a first and a second LED mounted within said heart shaped housing; and (E) circuit means responsive to said first and second conductors and being disposed within said heart shaped housing for causing said light emitting means to intermittently emit said light when a conductive path exists between said first and second conductor;

whereby when said novelty item is held in a person's hand, said hand may form said conductive path and thereby cause said light emitting means to flash on and off as a symbolic visual depiction of a heart beat.

2. The novelty item of claim 1 wherein said first LED intermittently emits said light at a rate different than said second LED.

3. The novelty item of claim 1 wherein said heart shaped housing includes a translucent window disposed therein, such that said light emitting means emits said light through said translucent window to render it visible exterior to said heart shaped housing.

4. The novelty item of claim 3 wherein said heart shaped housing includes a stand attached thereto to allow said heart shaped housing to be supported in a substantially upright position.

* * * * *